US007234195B2

(12) United States Patent
Matsushita

(10) Patent No.: US 7,234,195 B2
(45) Date of Patent: Jun. 26, 2007

(54) CLEANING APPARATUS USING COMPRESSED AIR

(75) Inventor: Tsuyoshi Matsushita, Nagoya (JP)

(73) Assignee: Mtg. Co., Ltd. (JP)

( * ) Notice: Subject to any disclaimer, the term of this patent is extended or adjusted under 35 U.S.C. 154(b) by 694 days.

(21) Appl. No.: 10/471,034

(22) PCT Filed: Jun. 26, 2003

(86) PCT No.: PCT/JP03/08126

§ 371 (c)(1),
(2), (4) Date: Sep. 5, 2003

(87) PCT Pub. No.: WO2004/026494

PCT Pub. Date: Apr. 1, 2004

(65) Prior Publication Data

US 2005/0150526 A1 Jul. 14, 2005

(30) Foreign Application Priority Data

Sep. 19, 2002 (JP) ..... 2002-273832

(51) Int. Cl.
*B08B 9/027* (2006.01)

(52) U.S. Cl. ..... 15/302; 15/304; 15/316.1; 15/319

(58) Field of Classification Search ..... 15/304, 15/316.1, 302, 319, 406
See application file for complete search history.

(56) References Cited

U.S. PATENT DOCUMENTS

| | | | | |
|---|---|---|---|---|
| 5,311,641 | A * | 5/1994 | Matsuura et al. | 15/406 |
| 5,355,844 | A * | 10/1994 | Kendrick | 15/316.1 |
| 5,649,338 | A * | 7/1997 | Kato | 15/304 |
| 5,860,187 | A * | 1/1999 | Flaszynski et al. | 15/304 |

FOREIGN PATENT DOCUMENTS

| | | |
|---|---|---|
| JP | 2-37236 | 9/1983 |
| JP | 11-131543 | 5/1999 |
| JP | 2000-157939 | 6/2000 |
| JP | 2000-246202 | 9/2000 |
| JP | 2002-054199 | 2/2002 |

* cited by examiner

*Primary Examiner*—Theresa T. Snider
(74) *Attorney, Agent, or Firm*—Stetina Brunda Garred & Brucker

(57) ABSTRACT

A cleaning apparatus has a compressor (12), an electromagnetic valve (33) connected to the compressor (12), and first to third timers (27 to 29). The first timer (27) sets an open/close time and a close time for repeatedly opening and closing an electromagnetic valve (33). The second timer (28) sets a time for feeding compressed air into a pipe (35). The third timer (29) stops the operation of the second timer (28) until an activation inhibition time elapses from a point at which the pressure of the compressed air has reached a predetermined upper limit, and further permits the operation of the second timer (28) after the activation inhibition time elapses.

12 Claims, 3 Drawing Sheets

CLEANING APPARATUS USING COMPRESSED AIR

BACKGROUND OF THE INVENTION

The present invention relates to a cleaning apparatus that cleans a cleaning target (a subject to be cleaned), such as a water pipe, using compressed air.

For example, Japanese Examined Patent Publication No. 2-37236 discloses a pipe cleaning apparatus for cleaning a pipe as a cleaning target. The pipe cleaning apparatus has a compressor, a reservoir tank that is connected to the compressor and reserves compressed air, and an electromagnetic valve that communicates with the reservoir tank via a pressure adjustment valve. The pipe cleaning apparatus repeats opening and closing the electromagnetic valve according to a predetermined open time and close time during a predetermined operation time. The pipe cleaning apparatus has an air spurt timer, which determines the open time in order to adjust the expelling amount of compressed air, and an air stop timer, which determines the close time in order to adjust the expelling period for the compressed air. Further, the pipe cleaning apparatus has a general work timer that sets the operation time.

The compressed air that is produced by the compressor is temporarily reserved in the reservoir tank, and then is fed to the electromagnetic valve from the reservoir tank. Thereafter, as the electromagnetic valve is opened, compressed air is fed from the electromagnetic valve to a pipe to be a cleaning target. The electromagnetic valve alternately repeats being opened and closed according to the open time and the close time to intermittently expel the compressed air to the pipe. The compressed air that has been expelled intermittently causes a water hammer action in the pipe, thus removing an adhered matter, such as an oil component, rust, or dust, adhered to the inner surface of the pipe. The pipe cleaning apparatus is automatically operated during the operation time set by the general work timer and is automatically stopped after the operation time elapses.

In case of the conventional pipe cleaning apparatus, as compressed air is reserved in the reservoir tank, reduction in pressure is prevented during cleaning. The operation time is set only by the general work timer regardless of the capacity or the like of the compressor. In the actual cleaning work, however, it is very likely that the operational state of the compressor varies according to the work conditions, such as the temperature at the cleaning spot and the supply electricity. In this case, the compressed air may be expelled to a pipe in a state where the pressure of the compressed air to be expelled to the pipe is less than a sufficient value. It is therefore necessary for a worker to always observe the pressure of the compressed air and to stop the pipe cleaning apparatus or readjust the pressure of the compressed air every time it drops. As a result, the cleaning work cannot be simplified, thereby bringing about a reduction in working efficiency.

BRIEF SUMMARY OF THE INVENTION

It is an object of the present invention to provide a pipe cleaning apparatus capable of improving the working efficiency by simplifying the cleaning work.

To achieve the object, the present invention provides the following cleaning apparatus. The cleaning apparatus cleans a cleaning target using compressed air. The apparatus has a compressor, an air feeding passage, an electromagnetic valve, a first timer, a second timer, and a third timer. The compressor produces compressed air. The air feeding passage extends between the compressor and the cleaning target. As the compressed air is fed to the cleaning target via the air feeding passage from the compressor while letting water flow into the cleaning target, the insides of the cleaning target is cleaned. The electromagnetic valve is provided in a midway in the air feeding passage. The electromagnetic valve is opened or closed in such a way that expelling of the compressed air to the cleaning target from the compressor is permitted or restricted. The first timer sets an open time and close time of the electromagnetic valve in order to cyclically open and close the electromagnetic valve. The second timer sets a feed time for feeding the compressed air into the cleaning target. During the feed time, the electromagnetic valve repeats being opened and closed according to the open time and the close time set by the first timer. The third timer sets an activation inhibition time for the second timer. The third timer permits an operation of the second timer after the activation inhibition time has elapsed since a point at which pressure of the compressed air from the compressor reached a predetermined upper limit.

The present invention also provides another cleaning apparatus, which cleans a cleaning target using compressed air. The apparatus has a compressor, an air feeding passage, an electromagnetic valve, and control means. The compressor produces compressed air. The air feeding passage extends between the compressor and the cleaning target. As the compressed air is fed to the cleaning target via the air feeding passage from the compressor while letting water flow into the cleaning target, the insides of the cleaning target is cleaned. The electromagnetic valve is provided in a midway in the air feeding passage. The electromagnetic valve is cyclically opened and closed at a time of cleaning the cleaning target. The compressed air is intermittently fed toward the cleaning target from the compressor in accordance with opening and closing actions of the electromagnetic valve. The control means permits the opening and closing actions of the electromagnetic valve after a predetermined time has elapsed since a point at which pressure of the compressed air from the compressor reached a predetermined upper limit.

BRIEF DESCRIPTION OF DRAWINGS

FIG. 1(*b*) is a side view of the pipe cleaning apparatus in FIG. 1(*a*).

FIG. 1(*c*) is a plain view of the pipe cleaning apparatus in FIG. 1(*a*).

FIG. 4(*b*) is a timing chart for explaining the operations of the second timer, and a first timer.

DETAILED DESCRIPTION OF THE PREFERRED EMBODIMENT

One embodiment of the present invention will be described below in detail based on FIG. 1(*a*) to FIG. 4(*b*).

Figure 1:
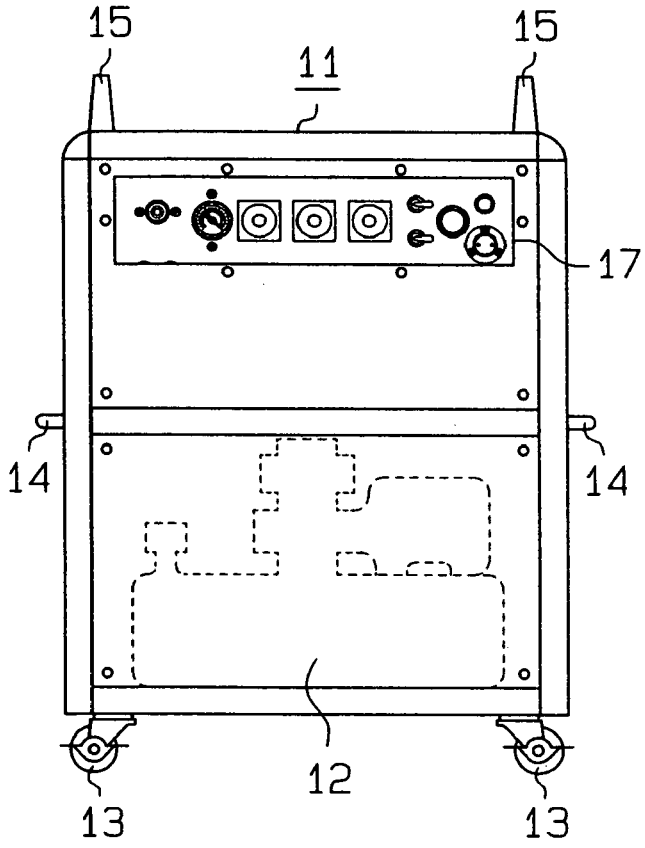
FIG. 1(*a*) is a front view of a pipe cleaning apparatus according to one embodiment embodying the invention.
Figure 1:
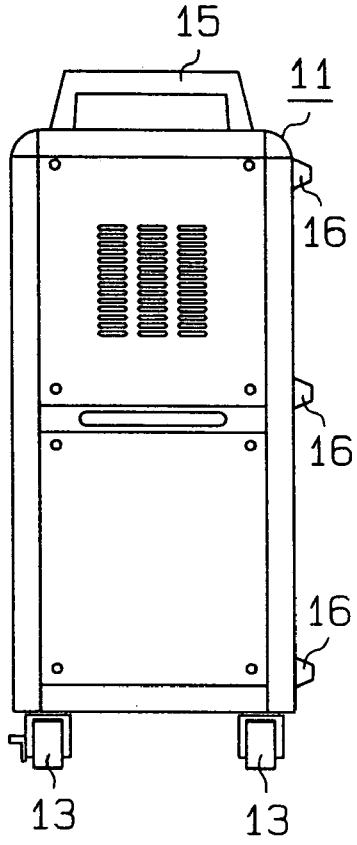
Figure 1:
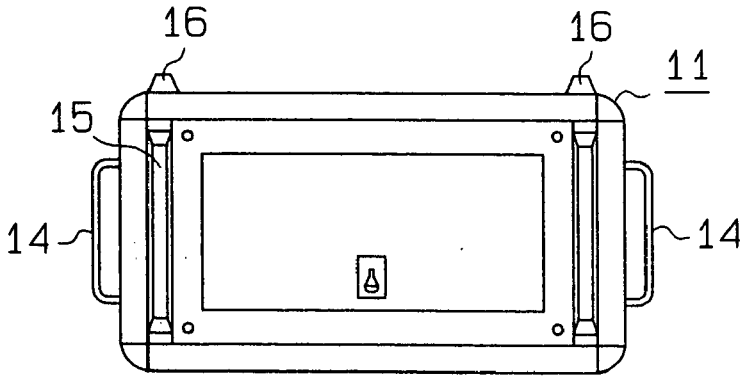
Figure 2:
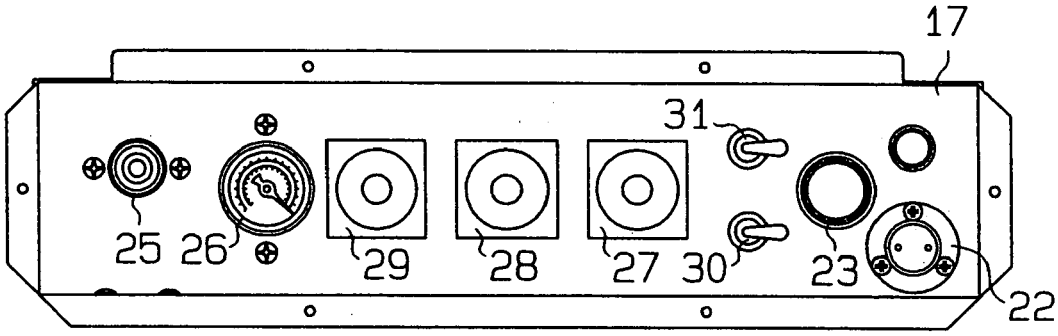
FIG. 2 is a front view of an operation panel provided on the pipe cleaning apparatus in FIG. 1(*a*).

As shown in FIG. 1(*a*) to FIG. 1(*c*), a pipe cleaning apparatus has a case 11 with a rectangular box shape formed of metal, such as an aluminum alloy, iron or stainless steel, and a compressor 12 fixed onto the bottom of the case 11. The pipe cleaning apparatus has a reservoir tank for reserving compressed air. Casters 13 are rotatably provided at the four corner portions of the bottom of the case 11 respectively. Pulls 14 are respectively attached to both side surfaces of the case 11. As a worker pulls the pulls 14 of the case 11 with his or her hands, and rolls the individual casters 13, a transporting work for the pipe cleaning apparatus is simplified.

A pair of handle portions 15 is protrusively provided on both side portions of the top surface of the case 11. As the worker holds those handle portions 15, it becomes easier to lift up the pipe cleaning apparatus at the time of transportation. Attached to the back of the case 11 is a plurality of leg portions 16 with a conical trapezoidal shape of an elastic material, such as a synthetic resin or synthetic rubber. As the pipe cleaning apparatus is placed on a setup surface via the casters 13, it can be used in an upright state as shown in FIGS. 1(*a*) and 1(*b*). As the pipe cleaning apparatus is placed on the setup surface via the plurality of leg portions 16, however, it can be used in an unillustrated sideway state, too. The case where the pipe cleaning apparatus is used in the sideway state has an advantage of having a higher stability as compared with the upright state.

As shown in FIGS. 1(*a*), 2, and 3, an operation panel 17 for making various kinds of setting concerning the expelling of compressed air to be supplied into a pipe 35 to be cleaned is provided at the upper portion of the front side of the case 11. Attached to the right side portion of the operation panel 17 are a power supply connecting section 22 for connecting a power supply cord 21 (see FIG. 3) to be discussed later, and a pressure adjustment knob 23, which is manipulated at the time of adjusting the expelling pressure of the compressed air. Meanwhile, a coupler 25 for connecting a hose 24 to be discussed later is protrusively provided on the left side portion of the operation panel 17 and a pressure gauge 26 for measuring the expelling pressure of the compressed air is attached to a position adjacent to the coupler 25. A third timer 29, a second timer 28, and a first timer 27 are attached to the right to the pressure gauge 26 in order from the left side. The third timer 29 functions as control means. A main switch 30 and a drive switch 31 are attached onto the operation panel 17 between the first timer 27 and the pressure adjustment knob 23. The main switch 30 is used to turn on or off the compressor 12. The drive switch 31 is used to set the first timer 27, the second timer 28, and the third timer 29 on or off.

Figure 3:
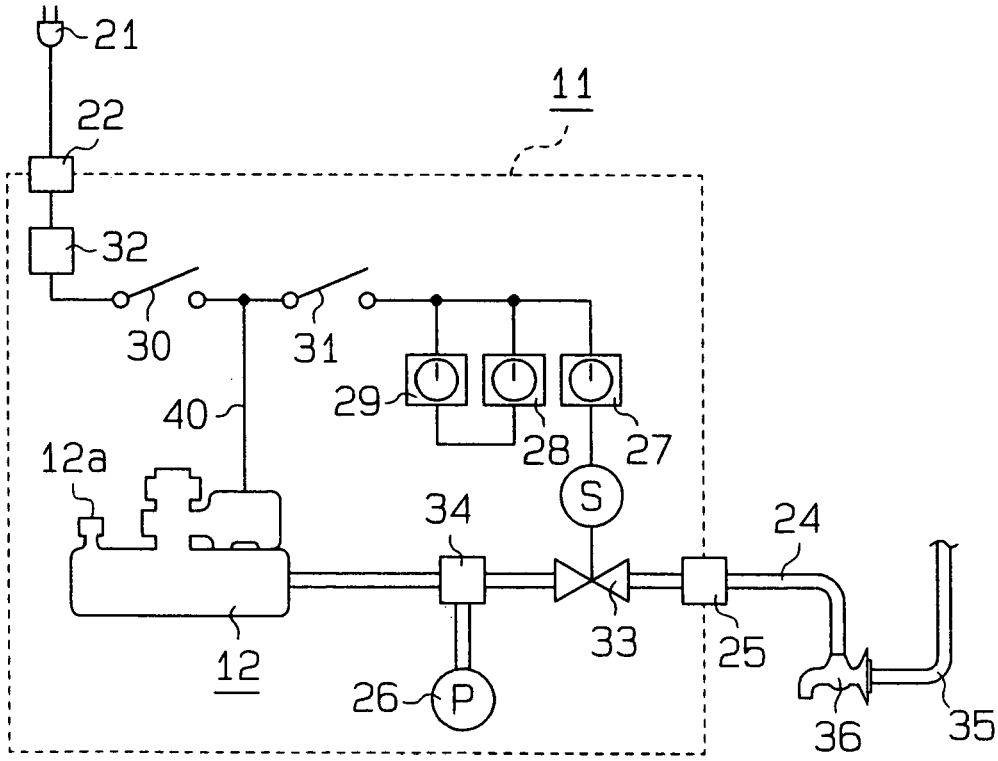
FIG. 3 is a schematic circuit diagram showing the structure of the pipe cleaning apparatus.

FIG. 3 is a circuit diagram showing the structure of the pipe cleaning apparatus. Outside the case 11, the power supply cord 21 is connected to the power supply connecting section 22, and is also connected to an unillustrated power supply. The compressor 12 is connected to the power supply connecting section 22 via the main switch 30. A constant voltage device 32 is connected between the power supply connecting section 22 and the main switch 30. The constant voltage device 32 functions so as to always supply electricity of a constant voltage (100 V in this embodiment) to the compressor 12 even in the case where the power supply cord 21 is connected to a power supply of a different voltage, such as 90 V or 95 V. At the time the main switch 30 is set on, the supply of electricity to the compressor 12 from the power supply is permitted, so that the compressor 12 is driven.

A faucet 36 is connected to the end portion of the pipe 35. One end of the hose 24 is connected to the coupler 25 outside the case 11. The other end of the hose 24 is connected to that portion of the faucet 36 from which the handle portion of the faucet 36 is removed. An electromagnetic valve 33 is connected to the coupler 25 inside the case 11. The electromagnetic valve 33 is connected to the compressor 12 via a regulator 34. An air pipe extending between the compressor 12 and the coupler 25 and the hose 24 constitute an air feeding passage. The expelling of the compressed air to the pipe 35 from the compressor 12 is permitted or restricted in accordance with the opening/closing operation of the electromagnetic valve 33.

The compressed air produced by the compressor 12 is expelled to the hose 24 via the regulator 34, the electromagnetic valve 33 and the coupler 25 with the electromagnetic valve 33 opened. The compressed air expelled to the hose 24 is fed into the pipe 35 via the faucet 36. At this time, water is supplied into the pipe 35. With water flowing into the pipe 35, the compressed air is fed into the pipe 35 from the compressor 12. The fed compressed air, mixed with the water, flows into the pipe 35, removes an adhered matter, such as an oil component, rust or dust, adhered to the inner surface of the pipe 35 and is expelled, together with the removed adhered matter, from another unillustrated faucet. As the electromagnetic valve 33 is closed, the expelling of the compressed air to the hose 24 is restricted, and feeding of the compressed air into the pipe 35 is stopped.

As the worker manipulates the pressure adjustment knob 23, the degree of opening of the regulator 34 connected to the pressure adjustment knob 23 is adjusted, thereby regulating the pressure of the compressed air to be fed into the pipe 35. The pressure of the compressed air to be fed into the pipe 35 is regulated by the regulator 34 in accordance with the cleaning scale, such as the diameter and length of the pipe 35. The pressure gauge 26 is connected to the regulator 34. The pressure of the compressed air to be fed to the electromagnetic valve 33 from the compressor 12 is measured by the pressure gauge 26 at the time the compressed air passes the regulator 34. Looking at the pressure gauge 26, the worker can confirm the pressure of the compressed air to be fed into the pipe 35.

Figure 4A:
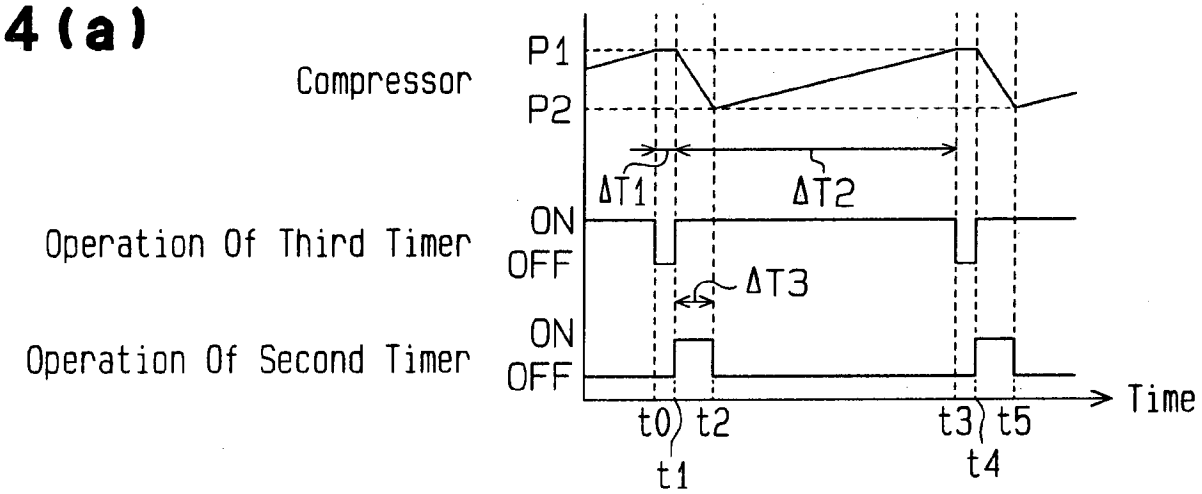
FIG. 4(*a*) is a timing chart for explaining the operations of a compressor, a third timer and a second timer.
Figure 4B:
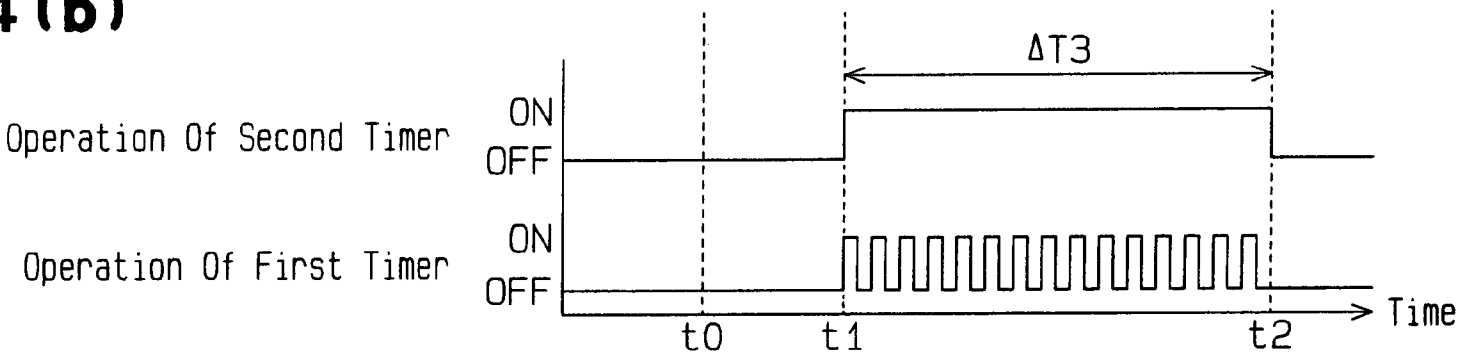

The compressor 12 is driven in such a mode as illustrated by a timing chart in FIG. 4(*a*). An upper limit P1 and a lower limit P2 of the pressure of the compressed air in the compressor 12 are preset in accordance with the capacity of the compressor 12. The pressure of the compressed air in the compressor 12 is always detected by a pressure sensor 12*a* shown in FIG. 3. When the pressure sensor 12*a* detects that the pressure of the compressed air in the compressor 12 has dropped to the lower limit P2 from the upper limit P1 due to expelling, the compressor 12 performs a boosting operation based on an ON signal from the pressure sensor 12*a*.

When the pressure sensor 12*a* detects that the pressure has reached the upper limit P1 by the boosting operation of the compressor 12, the compressor 12 stops the boosting operation based on an OFF signal from the pressure sensor 12*a*, and the boosting operation of the compressor 12 stands by until the pressure of the compressed air drops to the lower limit P2 again. With the boosting operation of the compressor 12 in standby state, the electromagnetic valve 33 is opened, and the compressed air is expelled toward the pipe 35 from the compressor 12. In this embodiment, the lower limit P2 is set to 6 $kg/cm^2$ and the upper limit P1 is set to 8 $kg/cm^2$.

In case of an ordinary compressor, when electricity to be supplied to the compressor runs short as in, for example, a summer season where there is excess power consumption or in the case where electricity is supplied from an old type of power supply, even if the boosting operation of the compressor is performed, there is a high probability of occurrence of a shortcoming, such that the pressure of the compressed air inside does not reach the upper limit P1, or the boosting operation period of the compressor needed to boost the pressure of the compressed air from the lower limit P2 to the upper limit P1 varies, or the compressor is not driven.

In case of the compressor 12 of this embodiment, on the other hand, electricity of a constant voltage is supplied by the constant voltage device 32. Therefore, the interval from time t2 to time t3 in FIG. 4(*a*), i.e., the boosting operation period of the compressor 12 needed to boost the pressure of the compressed air from the lower limit P2 to the upper limit P1 is always constant. In this embodiment, the interval from time t2 to time t3 is 34 seconds.

The second timer 28 determines a feeding time ΔT3 for the compressed air to be fed into the pipe 35. The feeding time ΔT3 is equivalent to the interval from time t1 to time t2 in FIG. 4(*a*) (or the interval from time t4 to time t5), i.e., the period for the pressure of the compressed air to drop to the lower limit P2 from the upper limit P1. The pressure of the compressed air to be expelled is set to a desired value by the regulator 34, and the feeding time ΔT3 for the compressed air is set to a desired value by the second timer 28. Therefore, the expelling amount of the compressed air in the set feeding time ΔT3 can be set to a value as desired. In the present embodiment, the interval from time t1 to time t2 is set to 6 seconds (see FIG. 4(*a*)).

As shown in FIG. 3, a line 40 extending from the main switch 30 in the case 11 is branched to run toward the compressor 12 and the drive switch 31. The drive switch 31 connected to the line 40 is further connected in series to the third timer 29, the second timer 28, and the first timer 27, and the electromagnetic valve 33 is electrically connected to the first timer 27. When the drive switch 31 is set on with the main switch 30 being on, the electricity, which has been adjusted to be a constant voltage by the constant voltage device 32, is supplied to the three timers 27, 28, and 29 in the order of the third timer 29, the second timer 28, and the first timer 27. As the third timer 29, the second timer 28, and the first timer 27 are driven with the constant voltage, they always operate at the accurate times.

The third timer 29 sets an activation inhibition time ΔT1 and activation allowance time ΔT2 of the second timer 28, according to the capacity of the compressor 12. When the pressure of the compressed air inside the compressor 12 reaches the upper limit P1, and the compressor 12 becomes a state immediately after the boosting operation stops (equivalent to time t0 or time t3), as shown in FIG. 4(*a*), it is very likely that the pressure inside the compressor 12 has not become uniform entirely. Depending on the cleaning spot, the boosting operation period of the compressor 12, i.e., the interval from time t2 to time t3 may extend slightly. In the case where expelling of compressed air into the pipe 35 starts immediately at time t0 at which the operation of the compressor 12 is stopped, the pressure of the compressed air at the time expelling starts may not reach the upper limit P1.

In consideration of the above, to always set the pressure of the compressed air to the upper limit P1 at the time the expelling begins, it is necessary to start the expelling of the compressed air after a predetermined time has elapsed from time t0, at which the operation of the compressor 12 is stopped, or when the pressure of the compressed air inside the compressor 12 becomes stable. In this embodiment, therefore, the activation inhibition time ΔT1 from time t0 to time t1 (or from time t3 to time t4) shown in FIG. 4(*a*) is set as the predetermined time. During the activation inhibition time ΔT1, the third timer 29 is kept off, thereby setting the second timer 28 off until the activation inhibition time ΔT1 elapses. Note that the third timer 29, the second timer 28, and the first timer 27 being off does not mean the stop of the measuring operation but indicates the cutoff of the supply of the electricity to the downstream of themselves.

After the pressure of the compressed air in the compressor 12 becomes stable, expelling of the compressed air into the pipe 35 may be initiated any time. Accordingly, during the activation allowance time ΔT2 from time t1 to time t3 shown in FIG. 4(*a*), the third timer 29 is kept on, thereby allowing the second timer 28 to operate for the activation allowance time ΔT2. In the present embodiment, the activation inhibition time ΔT1 is set to 2 seconds, and the activation allowance time ΔT2 is set to 40 seconds.

The second timer 28 sets the feeding time ΔT3 for the compressed air into the pipe 35 within the activation allowance time ΔT2. Specifically, the second timer 28 is set on so as to permit the first timer 27 to be on at time t1 at which time the activation allowance time ΔT2 starts, as shown in FIG. 4(*b*). Then, the second timer 28 is set off at time t2 at which the boosting operation of the compressor 12 starts, setting off the first timer 27 at time t2 as a consequence. As the compressed air of 6 to 8 kg/cm$^2$ is fed into the pipe 35 for the feeding time ΔT3, the desired amount of compressed air is expelled into the pipe 35. In the present embodiment, the feeding time ΔT3 for the compressed air is set to 6 seconds to match with the interval from time t1 to time t2 during which the pressure of the compressed air becomes the lower limit P2 from the upper limit P1.

The first timer sets the open time and close time of the electromagnetic valve in order to cyclically open and close the electromagnetic valve 33. That is, the first timer 27 sets the expelling interval of compressed air. Specifically, the first timer 27 is repeatedly set on and off every predetermined time interval, as shown in FIG. 4(*b*). The electromagnetic valve 33 is opened to expel the compressed air during the time in which the first timer 27 is set on, and the electromagnetic valve 33 is closed to restrict the expelling of the compressed air during the time in which the first timer 27 is set off. As a result, as the electromagnetic valve 33 is repeatedly opened and closed, the compressed air is intermittently expelled into the pipe 35. The compressed air expelled into the pipe 35 causes a water hammer action in the pipe 35 to vibrate and remove a foreign matter, such as an oil component, rust or dust, adhered to the inner surface of the pipe 35 by its impact. In the present embodiment, the first timer 27 sets the electromagnetic valve 33 on and off every 0.2 second.

The operation of the pipe cleaning apparatus will be described below.

At the time of cleaning the pipe 35 using the pipe cleaning apparatus, first, a worker transports the pipe cleaning apparatus to a working site, and then places the case 11 in an upright state (see FIG. 1(*a*)) or a sideway state in accordance with the extent of the cleaning site. Next, as shown in FIG. 3, the worker connects the power supply connecting section 22 of the operation panel 17 to the unillustrated power supply by the power supply cord 21, and then connects the coupler 25 to the faucet 36 by the hose 24. Thereafter, the worker manually sets the operation times of the third timer 29, the second timer 28, and the first timer 27 on the operation panel 17 based on the upper limit P1 and lower limit P2 (see FIG. 4(*a*)) of the pressure of the compressed air according to the capacity of the compressor 12, which completes the cleaning preparation.

After the cleaning preparation is completed, when the main switch 30 on the operation panel 17 is set on, the compressor 12 is driven to start the boosting operation. After the worker confirms based on the stopping of the boosting operation of the compressor 12 that the pressure of the compressed air has reached the upper limit P1 (time t0 in FIG. 4(*a*)) thereafter, water is allowed to flow into the pipe 35, and the drive switch 31 is set on. Then, the compressed air is intermittently fed into the pipe 35 based on the operations of the third timer 29, the second timer 28, and the first timer 27. The compressed air is mixed with the water in the pipe 35, and the mixture flows into the pipe 35. At that time, the impact wave of the compressed air removes a foreign matter, such as an oil component, rust, or dust, adhered to the inner surface of the pipe 35, and is dispersed into water. As another unillustrated faucet connected to the pipe 35 is opened in this state, the mixture containing the removed foreign matter is expelled from the faucet to clean the inside of the pipe 35.

During cleaning, the opening/closing operation of the electromagnetic valve 33 is performed according to the times set by the third timer 29, the second timer 28, and the first timer 27. During cleaning, therefore, most of the work is automated, so that it is unnecessary for the worker to always observe the pressure, and readjust the pressure, making the work simpler. As the worker turns off the drive switch 31 and the main switch 30 in order after having confirmed that no further foreign matter has been expelled from the unillustrated another faucet, the work of cleaning inside the pipe 35 is completed, and the pipe cleaning apparatus is moved to another cleaning site.

The present embodiment has the following advantages.

The third timer 29, the second timer 28, and the first timer 27 automatically prevent excessive fall of the pressure of the compressed air during cleaning. It is therefore possible to automate most of the cleaning work, and the simplification of the cleaning work can improve the working efficiency.

The constant voltage device 32 always supplies electricity of a constant voltage to the compressor 12, the third timer 29, the second timer 28, and the first timer 27. Even under a circumstance, such as a summer season where power consumption of the compressor 12 becomes excessively large or in the case where electricity is supplied from an old type of power supply, the boosting operation period of the compressor 12 (from time t2 to time t3 in FIG. 4(*a*)) can be always set constant, so that the compressor 12 can be driven stably without causing a problem. Further, the third timer 29, the second timer 28, and the first timer 27 can be operated accurately without making the working times wrong.

The boosting operation of the compressor 12, stopping of the boosting operation, and the standby of the boosting operation are carried out based on the lower limit P2 and upper limit P1 of the pressure of the compressed air that are preset in accordance with the capacity of the compressor 12. Therefore, the compressor 12 can be used efficiently, contributing to further simplification of the cleaning work.

The present embodiment can be modified and worked as follows.

The third timer 29 may be connected to the pressure sensor 12*a* of the compressor 12 electrically so that the ON/OFF control of the third timer 29 is carried out based on the upper limit P1 and lower limit P2 of the pressure. Alternatively, the second timer 28 may be connected to the pressure sensor 12*a* of the compressor 12 electrically so that the ON/OFF control of the second timer 28 is carried out based on the upper limit P1 and lower limit P2 of the pressure. Or the first timer 27 may be connected to the pressure sensor 12*a* of the compressor 12 electrically so that the ON/OFF control of the first timer 27 is carried out based on the upper limit P1 and lower limit P2 of the pressure. When such a construction is taken, it is possible to easily set the operation times of the third timer 29, the second timer 28, and the first timer 27. A controller may be provided, such as a computer to control the third timer 29, the second timer 28, and the first timer 27.

A remote operation unit may be provided that can set the compressor 12 on and off from a remote place. In this case, a switch, which is operated by the remote operation unit, may be provided between the power supply connecting section 22 and the power supply cord 21, or between the power supply cord 21 and the power supply. Further, the remote operation unit may set on and off the third timer 29 as well as the compressor 12. When such a construction is taken, the pipe cleaning apparatus can be turned on or off at the time cleaning starts or cleaning ends, without requiring a worker to return to the cleaning site where the pipe cleaning apparatus is placed, thus ensuring a further improvement on the working efficiency. In the case where a plurality of pipe cleaning apparatuses are placed, a worker can set on and off those pipe cleaning apparatuses at a time by a remote operation unit, so that the working efficiency can be improved further.

A fourth timer may be connected between the main switch 30 and the constant voltage device 32, between the main switch 30 and the compressor 12, and so on. The fourth timer functions to set the cleaning time needed to complete cleaning of a cleaning target.

The drive switch 31 may be omitted.

The constant voltage device 32 may be omitted.

The invention claimed is:

1. A cleaning apparatus for cleaning a cleaning target using compressed air, said apparatus comprising:

a compressor for producing compressed air;

an air feeding passage extending between said compressor and said cleaning target, whereby the insides of said cleaning target is cleaned by feeding the compressed air to said cleaning target via said air feeding passage from said compressor while letting water flow into said cleaning target;

an electromagnetic valve, which is provided midway in said air feeding passage and is opened or closed in such a way that expelling of the compressed air to said cleaning target from said compressor is permitted or restricted;

a first timer, which sets an open time and close time of said electromagnetic valve in order to cyclically open and close said electromagnetic valve;

a second timer, which sets a feed time for feeding the compressed air into the cleaning target whereby during said feed time, said electromagnetic valve repeats being opened and closed according to said open time and said close time set by said first timer; and a third timer, which sets an activation inhibition time for said second timer and permits an operation of said second timer after said activation inhibition time has elapsed since a point at which pressure of the compressed air from said compressor reached a predetermined upper limit.

2. The cleaning apparatus according to claim 1, wherein said third timer further sets an activation allowance time following said activation inhibition time, and said second timer sets said feed time within the activation allowance time.

3. The cleaning apparatus according to claim 1, further comprising a constant voltage device for always supplying electricity of a constant voltage to said compressor.

4. The cleaning apparatus according to claim 3, wherein said constant voltage device is adapted to always supply electricity of a constant voltage to said first timer, said second timer, and said third timer.

5. The cleaning apparatus according to claim 1, wherein said compressor is adapted to start a boosting operation when pressure of the compressed air reaches a preset lower limit or less, and to stop the boosting operation when the pressure of the compressed air reaches said upper limit.

6. The cleaning apparatus according to claim 5, wherein said feed time is equivalent to a period for the pressure of the compressed air from said compressor to drop to said lower limit from said upper limit due to an opening/closing action of said electromagnetic valve.

7. The cleaning apparatus according to claim 1, wherein said third timer is adapted to stop supplying electricity to said first timer and said second timer during said activation inhibition time.

8. The cleaning apparatus according to claim 1, further comprising a regulator for regulating the pressure of the compressed air to be fed to said electromagnetic valve from said compressor, at a portion of said air feeding passage between said compressor and said electromagnetic valve.

9. The cleaning apparatus according to claim 1, further comprising a main switch for permitting or restricting supply of electricity to said compressor, and a drive switch for permitting or restricting supply of electricity to said first timer, said second timer, and said third timer under a condition in which supply of electricity to said compressor is permitted.

10. A cleaning apparatus for cleaning a cleaning target using compressed air, wherein said apparatus comprising:

a compressor for producing compressed air;

an air feeding passage extending between said compressor and said cleaning target, whereby the insides of said cleaning target is cleaned by feeding the compressed air to said cleaning target via said air feeding passage from said compressor while letting water flow into said cleaning target;

an electromagnetic valve, which is provided midway in said air feeding passage and which is cyclically opened and closed at a time of cleaning said cleaning target so that said compressed air is intermittently fed toward said cleaning target from said compressor in accordance with opening and closing actions of the electromagnetic valve;

control means, for permitting the opening and closing actions of said electromagnetic valve after a predetermined time has elapsed since a point at which pressure of the compressed air from said compressor reached a predetermined upper limit; and a constant voltage device for always supplying electricity of a constant voltage to said compressor.

11. The cleaning apparatus according to claim 10, wherein said constant voltage device is adapted to always supply electricity of a constant voltage to said control means.

12. The cleaning apparatus according to claim 10, wherein said compressor is adapted to start a boosting operation when pressure of the compressed air reaches a preset lower limit or less, and to stop the boosting operation when the pressure of the compressed air reaches said upper limit.

* * * * *